US006314699B1

(12) United States Patent
West

(10) Patent No.: US 6,314,699 B1
(45) Date of Patent: Nov. 13, 2001

(54) DECK SYSTEM WITH DECK CLIP

(75) Inventor: Ronald R. West, Provo, UT (US)

(73) Assignee: Kroy Building Products, Inc., York, NE (US)

( * ) Notice: Subject to any disclaimer, the term of this patent is extended or adjusted under 35 U.S.C. 154(b) by 0 days.

(21) Appl. No.: 09/232,330

(22) Filed: Jan. 15, 1999

(51) Int. Cl.[7] ..... E04B 5/00

(52) U.S. Cl. ..... 52/489.1; 52/483.1; 52/588.1; 52/177

(58) Field of Search ..... 52/483.1, 489.1, 52/731.1, 585.1, 582.1, 582.2, 177, 181, 463, 471

(56) References Cited

U.S. PATENT DOCUMENTS

| | | | | |
|---|---|---|---|---|
| 5,412,915 | * | 5/1995 | Johnson | 52/177 |
| 5,617,689 | * | 4/1997 | Beane | 52/489.1 |
| 5,632,123 | * | 5/1997 | Erwin | 52/177 |
| 5,660,016 | * | 8/1997 | Erwin | 52/483.1 |
| 5,692,345 | * | 12/1997 | Mogaki | 52/483.1 |
| 5,758,467 | * | 6/1998 | Snear | 52/592.1 |
| 5,833,386 | * | 11/1998 | Rosan | 52/177 |
| 5,950,377 | * | 9/1999 | Yoder | 52/177 |

* cited by examiner

*Primary Examiner*—Beth A. Stephan
(74) *Attorney, Agent, or Firm*—Clayton, Howarth & Cannon, P.C.

(57) ABSTRACT

A deck system with a deck clip. The deck system includes deck boards in which receiving chambers are formed. The receiving chambers are formed in both opposing side edges of each deck board, and each chamber is defined in part by a lip edge. The deck boards are placed side by side during construction of a deck, closely spaced, such that the lip edges of adjacent deck boards define a narrow channel space therebetween in which a rotatable deck clip is placed. The clip has a first overhang member and an opposing second overhang member and is thereby wider in a first horizontal dimension and shorter in a second, perpendicular horizontal dimension, and is rotatably attached to the deck joists by a screw or other fastening device. When the clip is rotated into a first position, its first and second overhang members extend into the receiving chambers of adjacent deck boards and engage with the lip edges of each chamber to hold the deck boards securely in place upon the joists. Users may easily remove a deck board by simply rotating the clip ninety degrees to thereby move the overhang members of the clip into the channel space between the lip edges, and the deck boards are thereby released.

70 Claims, 2 Drawing Sheets

DECK SYSTEM WITH DECK CLIP

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. The Field of the Invention

The present invention relates generally to the construction of decks, and more particularly, but not exclusively, to a decking release clip for securing and releasing deck boards to and from joists as part of a decking structure.

2. Description of Related Art

Conventional methods of constructing decks, such as patio decking and the like, are adequate and generally effective, and yet they lack certain advantages. For example, it is known to construct a deck by placing deck boards side by side upon deck joists, then attaching the deck boards to the joists with nails or screws. If the owner of such a deck desires to replace one or more deck boards, for example due to damage or discoloration to the deck boards, the owner must undertake the laborious and time consuming steps of prying the deck boards from the joints if they are nailed, or unscrew the screws holding the deck boards. This can sometimes cause further damage to the deck boards or to the joists.

BRIEF SUMMARY AND OBJECTS OF THE INVENTION

It is therefore an object of the present invention to provide a deck structure that is simple to assemble and permits easy removal of deck boards.

It is another object of the present invention to provide such a deck structure that is modular.

The above objects and others not specifically recited are realized in a specific illustrative embodiment of a deck system with a deck clip. The deck system includes deck boards in which receiving chambers are formed. The receiving chambers are formed in both opposing side edges of each deck board, and each chamber is defined in part by a lip edge. The deck boards are placed side by side during construction of a deck, closely spaced, such that the lip edges of adjacent deck is boards define a narrow channel space therebetween in which a rotatable deck clip is placed. The clip has a first overhang member and an opposing second overhang member and is thereby wider in a first horizontal dimension and shorter in a second, perpendicular horizontal dimension, and is rotatably attached to the deck joists by a screw or other fastening device. When the clip is rotated into a first position, its first and second overhang members extend into the receiving chambers of adjacent deck boards and engage with the lip edges of each chamber to hold the deck boards securely in place upon the joists. Users may easily remove a deck board by simply rotating the clip ninety degrees to thereby move the overhang members of the clip into the channel space between the lip edges, and the deck boards are thereby released.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
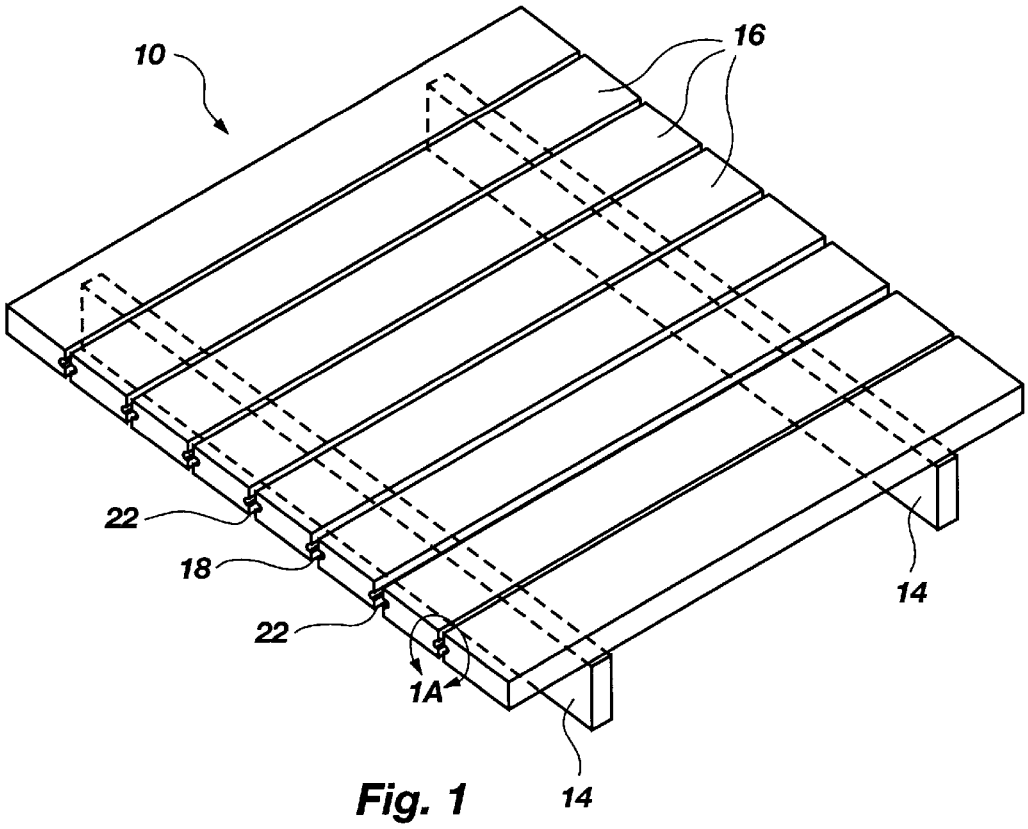
FIG. 1 is a schematic, perspective view of a deck structure made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicant has discovered that the construction and maintenance of decks are greatly enhanced by designing the deck boards to be removable, modular components of the deck. Applicant has thus conceived of a deck system in which a deck clip is rotatably mounting on the decking support structure, usually joists, for selectively engaging the releasing the deck boards to the joists as desired.

Referring now to FIGS. 1–6, there is shown a deck system designated generally at 10, with a deck clip 12 rotatably mounted on a deck joist 14. The deck system 10 includes deck boards 16 in which receiving chambers 18 are formed. The receiving chambers 18 are formed in both opposing side edges 20 of each deck board 16, and each chamber 18 is defined in part by a lip edge 22. The deck boards 16 are placed side by side during construction of the deck 10, closely spaced, such that the lip edges 22 of adjacent deck boards 16 define a narrow channel space 24 therebetween in which the rotatable deck clip 12 is placed. The clip 12 has a first overhang member 28 and an opposing second overhang member 30 and is thereby wider in a first horizontal dimension 32 and shorter in a second, perpendicular horizontal dimension 34, and is rotatably attached to the deck joists 14 by a screw 36 or other fastening device. The screw 36 may of course be described as a means for penetrating the decking support structure or joists 14.

Figure 1A:
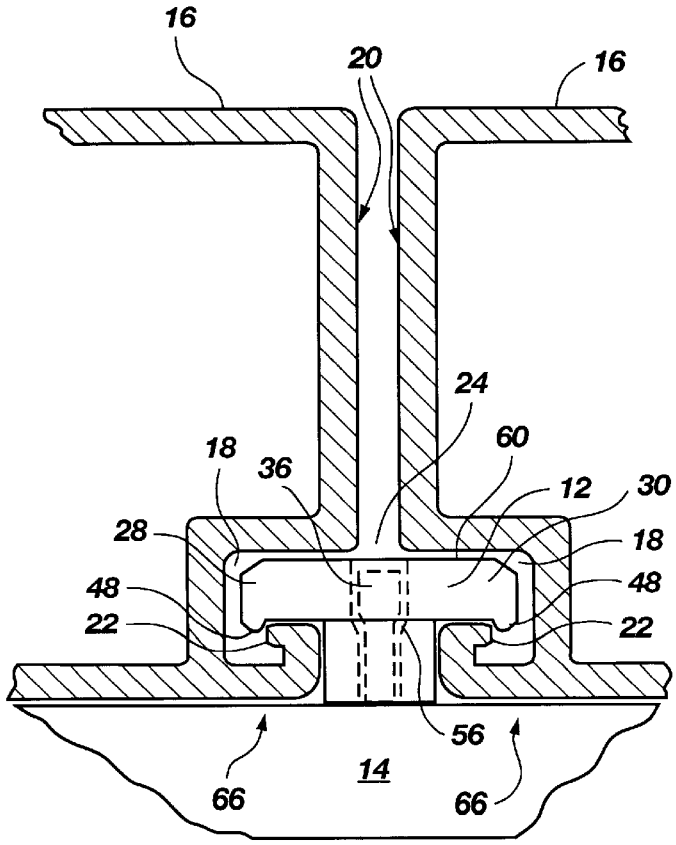
FIG. 1A is a break-away cross-sectional view of adjacent deck boards intercoupled by a deck clip equivalent to area 11 of FIG. 1 made in accordance with the principles of the present invention.
Figure 2:
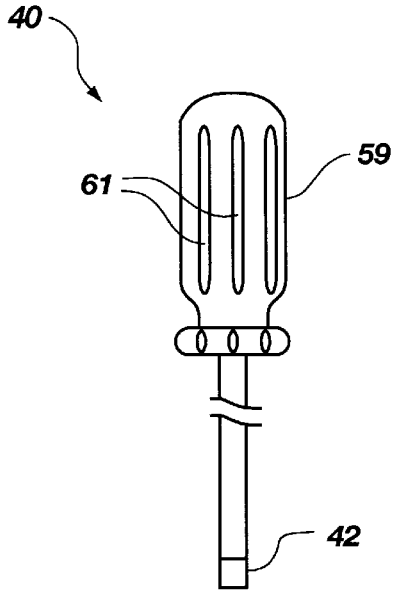
FIG. 2 is a side view of a deck clip turning member.

When the clip 12 is rotated into a first position as shown in FIG. 1A, its first and second overhang members 28 and 30 extend into the receiving chambers 18 of adjacent deck boards 16 and engage with the lip edges 22 of each chamber 18 to hold the deck boards 16 securely in place upon the joists 14. Users may easily remove a deck board 16 by simply rotating the clip 12 ninety degrees into a section position to thereby move the overhang members 28 and 30 of the clip 12 into the channel space 24 between the lip edges 22. The deck boards 16 are thereby released because the overhang members 28 and 30 no longer reside above, nor are engaged with, the lip edges 22 and the deck boards 16 can simply be lifted up. The clip 12 is rotated with a rotating member 40 shown in FIG. 2, which resembles a common screw driver except that it terminates in a distal end portion 42 that is square in cross section.

Figure 4:
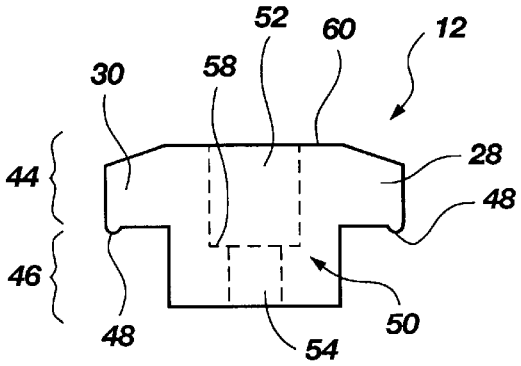
FIG. 4 is a side view of the deck clip of FIGS. 1A and 3.

Referring more particularly to FIG. 4, the deck clip 12 may be described as a securing member 12 having a first portion 44 and a second portion 46 fixedly secured to the first portion 44. The first portion 44 includes the first overhang member 28 extending outwardly to define an extension portion that extends outwardly with respect to the second portion 46, and the second overhang member 30. The extension or overhang portion is configured and dimensioned to extend into the receiving chamber 18 formed in the deck board 16 as shown in FIG. 1A.

The rotating member 40 may described as a turning means for (i) turning the securing member or clip 12 in a first rotational direction to thereby move the extension or overhang portions 28 and 30 into engagement with deck board 16, specifically, into engagement with the lip edges 22, and (ii) turning the securing member or clip 12 in a second rotational direction to thereby move the extension or overhang portions 28 and 30 out of engagement with the deck board 16.

The first portion 44 of the securing member 12 is an upper portion, and the second portion 46 of the securing member 12 is a lower portion fixedly secured to the upper portion. The extension or overhang portion 28 of 30 of the upper portion 44 extends outwardly to define an overhang with respect to the lower portion 46, said overhang portion being configured and dimensioned to extend into the receiving chamber 18 formed in a deck board 16.

The screw 36 may be described as a fastening means for fastening the securing member or clip 12 to the decking support structure or joists 14, in a manner to permit rotational movement of the clip 12 about the screw 36. As such, the screw 36 may be further described as a fastening means for rotatably fastening the securing member or clip 12 to the decking support structure or joists 14.

The overhang portions 28 and 30 may be further described as a first cantilever portion extending outwardly in a first direction to form a first overhang with respect to the lower portion 46, and an opposing second cantilever portion extending outwardly in a second direction to form an opposing second overhang with respect to the lower portion 46, respectively. At least one, and preferably both, of the overhang portions includes a nub 48 formed on a lower surface thereof. The nub 48 preferably extends in an orthogonal direction with respect to the upper portion 44 of the securing member or clip 12, as shown most clearly in FIG. 3.

Figure 3:
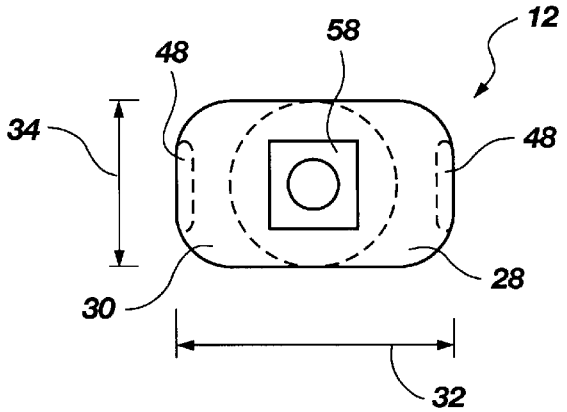
FIG. 3 is a top view of the deck clip of FIG. 1A.
Figure 5:
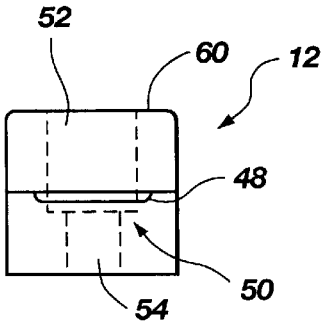
FIG. 5 is an end view of a tongue depressor portion of the breathing assist device of FIG. 3.

Referring more particularly to FIGS. 3–5, the securing member or clip 12 of course includes a through-passage 50 formed therein. The through-passage 50 extends sequentially through the first portion 44 of the clip 12 and the second portion 46 of the clip 12, respectively. The through-passage 50 includes a wider, upper portion 52 and a narrower, lower portion 54. The through-passage 50 may further include an intermediate portion 56 which is an annular ledge defined by a frusto-conical boundary as shown in FIG. 1A. Alternatively, the intermediate portion may instead comprise a planer annular ledge 58 as shown most clearly in FIGS. 2 and 4, said annular ledge 58 forming a boundary between the upper portion 52 and the lower portion 54 of the through-passage 50. The wider, upper portion 52 of the through-passage 50 preferably has a non-circular cross-sectional shape, and the narrower, lower portion 54 preferably has a circular cross-sectional shape.

The wider, upper portion 52 of the through-passage 50 is preferably square-shaped in cross section, but may constitute any non-circular shape desired, such as triangular, trapezoidal, and so forth. The cross-sectional area of the wider, upper portion 52 is preferably less than one-third, and more preferably less than one-fourth, of the area defined by an upper surface 60 of the securing member or clip 12.

The distal end portion 42 of the rotating member 40 is preferably narrower than the upper portion 52 of the through-passage 50 and wider than the lower portion 54 of the through-passage 50. The distal end portion 42 is configured and dimensioned to fit within the wider, upper portion 52 of the through-passage 50. A cross section of the distal end portion 42 of the rotating member 40, which rotating member may comprise a rod, defines a cross-sectional area that is at least seventy percent of a cross-sectional area defined by a cross section of the wider, upper portion 52 of the through-passage 50, and preferably at least ninety percent.

The rotating member 40 further comprises a gripping portion 59 having a plurality of channels 61 formed therein. The screw 36 includes seating means 37, in the form of a seating surface, for seating against the frusto-conical annular ledge 56 (in FIG. 1A) or the planer annular ledge 58 (in FIG. 4) to thereby prevent removal of the securing member or clip 12 from the decking support structure or joists 14.

The upper portion 44 of the clip 12 preferably includes an upper surface 60 having a generally rectangular dimension, and the lower portion 46 preferably has a generally circular cross section.

Stated in other terms, the securing member or clip 12 may be described in that the upper portion 44 has a first cantilever portion 28 extending outwardly in a first direction to form a first overhang with respect to the lower portion 46, and an opposing second cantilever portion 30 extending outwardly in a second direction to form an opposing second overhang with respect to the lower portion 46.

It is noted that the turning member 40 operates to turn the securing member or clip 12 without unfastening the screw 36 to thereby (i) turn the securing member or clip 12 into a first position as shown in FIG. 1A such that the nub 48 is disposed in engagement with the lip edge 22 of the deck board 16, and (ii) turn the securing member or clip 12 into a second position such that the nub 48 is no longer disposed in engagement with a deck board 16. Users may prefer to first loosen the screw 36 before turning the securing member or clip 12, if desired.

Figure 6:
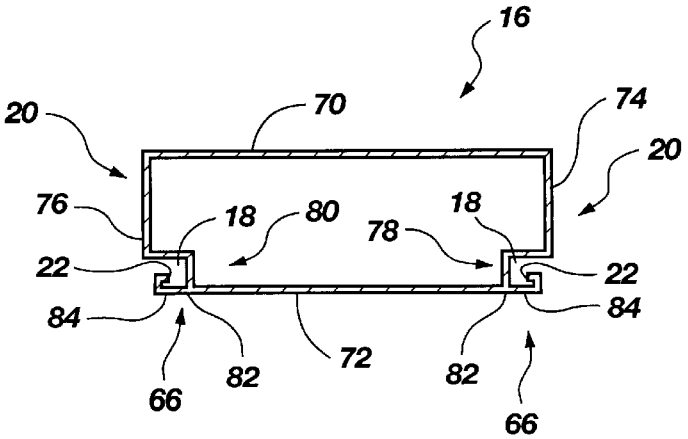
FIG. 6 is a cross-sectional view of a deck board, made in accordance with the principles of the present invention.

Referring now to FIGS. 1A and 6, it is shown that the receiving chamber 18 is defined in part by a channel member 66 having a J-shaped cross section. The cross-sectional dimensions of the receiving chamber 18 are larger than the cross-sectional dimensions of the upper portion 44 of the securing member or clip 12, in part to permit movement to accommodate expansion and contraction of the material of the deck boards 16 and of the clip 12. The nubs 48 are optional, but are preferred so as to inhibit rotational movement of the securing member or clip 12.

The channel member 66 and the receiving chamber 18 preferably extend along the entire length of the deck board 16. The deck boards 16 are preferably hollow as shown, preferably made from polyvinyl chloride material (PVC). The hollow cross section of the deck boards 16 is defined by an upper wall 70, a bottom wall 72, a first sidewall 74 and an opposing second sidewall 76 extending from opposing sides of the upper wall 70, respectively, and a first corner wall 78 and an opposing second corner wall 80 interconnecting the first sidewall 74 with the bottom wall 72 and the second sidewall 76 with the bottom wall 72, respectively.

The J-shaped channel members 66 extend from opposing edges 82 of the bottom wall 72. Each of the J-shaped channel members 66 preferably includes a sidewall 84 that is disposed in a substantial co-planer orientation with respect to the bottom wall 72. The J-shaped channel members 66 comprise three sequentially intercoupled sidewalls as shown, one of which is the sidewall 84. Each corner wall 78 and 80 comprises two interconnected sidewalls as shown in FIG. 6, and all of the sequentially intercoupled sidewalls of the J-shaped channel members 66 are narrower than each sidewall of the corner walls 78 and 80.

It will be appreciated that the preferred embodiment of the securing member or clip 12 comprises a means for engaging simultaneously with J-shaped channel members 78 and 80 of two adjacent deck boards 16. The J-shaped channel members 78 and 80 are preferably made from a resilient material having elastic memory, such as polyvinyl chloride (PVC).

It will be appreciated that the structure and apparatus disclosed herein is merely one example of a turning means for turning a securing member or clip 12, and it should be appreciated that any structure, apparatus or system for turning which performs functions the same as, or equivalent to, those disclosed herein are intended to fall within the scope of a turning means for turning an item, including those structures, apparatus or systems for imparting rotation which are presently known, or which may become available in the future. Anything which functions the same as, or equivalently to, a turning means for turning an item such as the securing member or clip 12 or any other item falls within the scope of this element.

It will be appreciated that the structure and apparatus disclosed herein is merely one example of a securing means for releasably securing deck boards to a decking support structure, and it should be appreciated that any structure, apparatus or system for securing which performs functions the same as, or equivalent to, those disclosed herein are intended to fall within the scope of a securing means for releasably securing one object to another, including those structures, apparatus or systems for securing which are presently known, or which may become available in the future. Anything which functions the same as, or equivalently to, a securing means for securing one object to another falls within the scope of this element.

In accordance with the features and combinations described above, a preferred method of securing deck boards in place as part of a decking structure includes the steps of:

(a) selecting a deck board having a receiving chamber formed therein;

(b) placing the deck board upon a deck support;

(c) attaching a securing member to any suitable structure, and positioning said securing member such that an overhang portion of said securing member extends into the receiving chamber of the deck board.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A deck-board securing device for securing deck boards in place as part of a decking structure, said securing device comprising:

a securing member having a first portion and a second portion fixedly secured to the first portion, said first portion having an overhang portion extending outwardly to define an extension portion that extends outwardly with respect to the second portion, said extension portion being configured and dimensioned to extend into a receiving chamber formed in a deck board;

turning means for (i) turning the securing member in a first rotational direction to thereby move the extension portion into engagement with a deck board, and (ii) turning the securing member in a second rotational direction to thereby move the extension portion out of engagement with the deck board; and fastening means for fastening the securing member to a decking support structure.

2. The deck-board securing device of claim 1, wherein the first portion of the securing member is an upper portion, and wherein the second portion of the securing member is a lower portion fixedly secured to the upper portion, the overhang portion extending outwardly to define an overhang with respect to the lower portion, said overhang portion being configured and dimensioned to extend into a receiving chamber formed in a deck board.

3. The deck-board securing device of claim 1, wherein the fastening means comprises means for rotatably fastening the securing member to a decking support structure.

4. The deck-board securing device of claim 1, wherein the turning means further comprises a gripping portion having a plurality of channels formed therein.

5. The deck-board securing device of claim 1, wherein the fastening means further comprises a means for penetrating the decking support structure.

6. The deck-board securing device of claim 5, wherein the fastening means comprises a threaded screw.

7. The deck-board securing device of claim 1, wherein the securing member comprises a lower portion and an upper portion disposed on the lower portion, a first cantilever portion extending outwardly from said upper portion in a first direction to form a first overhang with respect to the lower portion, and an opposing second cantilever portion extending outwardly from said upper portion in a second direction to form an opposing second overhang with respect to the lower portion.

8. The deck-board securing device of claim 7, wherein at least one of the overhangs includes a nub formed on a lower surface thereof.

9. The deck-board securing device of claim 8, wherein the turning means comprises means for turning the securing member without unfastening the fastening means to thereby (i) turn the securing member into a first position such that the nub formed on the lower surface of at least one overhang is disposed in engagement with a deck board, and (ii) turn the securing member into a second position such that said nub is no longer disposed in engagement with a deck board.

10. The deck-board securing device of claim 7, wherein said overhangs each include a nub formed on lower surfaces thereof.

11. The deck-board securing device of claim 10, wherein the turning means comprises means for turning the securing member without unfastening the fastening means to thereby (i) turn the securing member into a first position such that the nubs formed on the lower surfaces of the overhangs are disposed in engagement with adjacent deck boards, respectively, and (ii) turn the securing member into a second position such that said nubs are no longer disposed in engagement with deck boards.

12. The deck-board securing device of claim 1, wherein the first portion of the securing member comprises an upper portion having an upper surface, said upper surface having a downwardly-slanting end section.

13. The deck-board securing device of claim 12, wherein the upper portion includes an opposing second downwardly-slanting end section.

14. A deck-board securing device for securing deck boards in place as part of a decking structure, said securing device comprising:

a securing member having a first portion and a second portion fixedly secured to the first portion, said first portion having an overhang portion extending outwardly to define an extension portion that extends outwardly with respect to the second portion, said extension portion being configured and dimensioned to extend into a receiving chamber formed in a deck board; and turning means for (i) turning the securing member in a first rotational direction to thereby move the extension portion into engagement with a deck board, and (ii) turning the securing member in a second rotational direction to thereby move the extension portion out of engagement with the deck board;

wherein the first portion of the securing member is an upper portion, and wherein the second portion of the securing member is a lower portion fixedly secured to the upper portion, said upper portion having a first cantilever portion extending outwardly in a first direction to form a first overhang with respect to the lower portion, and an opposing second cantilever portion extending outwardly in a second direction to form an opposing second overhang with respect to the lower portion;

wherein at least one of the overhangs includes a nub formed on a lower surface thereof.

15. The deck-board securing device of claim 14, wherein the upper portion includes an upper surface having a generally rectangular dimension, and wherein the lower portion has a generally circular cross section.

16. A deck-board securing device for securing deck boards in place as part of a decking structure, said securing device comprising:

a securing member having a first portion and a second portion fixedly secured to the first portion, said first portion having an overhand portion extending outwardly to define an extension portion that extends outwardly with respect to the second portion, said extension portion being configured and dimensioned to extend into a receiving chamber formed in a deck board;

the securing member further including a through-passage formed therein; and turning means for (i) turning the securing member in a first rotational direction to thereby move the extension portion into engagement with a deck board, and (ii) turning the securing member in a second rotational direction to thereby move the extension portion out of engagement with the deck board.

17. The deck-board securing device of claim 16, wherein the through-passage extends through both the first portion of the securing member and the second portion of the securing member, respectively.

18. The deck-board securing device of claim 17, wherein the through-passage includes an upper portion and a lower portion, the upper portion being relatively wider with respect to the lower portion and the lower portion being relatively narrower with respect to the upper portion.

19. The deck-board securing device of claim 18, wherein the through-passage further includes an intermediate portion defined by a frusto-conical boundary.

20. The deck-board securing device of claim 17, wherein the through-passage includes an upper portion having a non-circular cross-sectional shape, and a lower portion, the upper portion being relatively wider with respect to the lower portion and the lower portion being relatively narrower with respect to the upper portion.

21. The deck-board securing device of claim 20, wherein the turning means includes a distal end portion that is narrower than the upper portion of the through-passage and wider than the lower portion of the through-passage.

22. The deck-board securing device of claim 20, wherein the narrower, lower portion of the through-passage has a circular cross-sectional shape.

23. The deck-board securing device of claim 20, wherein the wider, upper portion of the through-passage has a square cross-sectional shape.

24. The deck-board securing device of claim 23, wherein the turning means comprises an elongate rod terminating in a distal end portion having a square cross-sectional shape configured and dimensioned to fit within the wider, upper portion of the through-passage.

25. The deck-board securing device of claim 24, wherein a cross section of the distal end portion of the rod defines a cross-sectional area that is at least seventy percent of a cross-sectional area defined by a cross section of the wider, upper portion of the through-passage.

26. The deck-board securing device of claim 24, wherein a cross section of the distal end portion of the rod defines a cross-sectional area that is at least ninety percent of a cross-sectional area defined by a cross section of the wider, upper portion of the through-passage.

27. The deck-board securing device of claim 20, wherein the wider, upper portion of the through-passage has a triangular cross-sectional shape.

28. The deck-board securing device 18, wherein a cross-sectional area of the wider, upper portion is preferably less than one-third of an area defined by an upper surface of the securing member.

29. The deck-board securing device of claim 18, wherein the securing member includes an annular ledge formed therein, said annular ledge forming a boundary between the upper portion and the lower portion of the through-passage.

30. The deck-board securing device of claim 29, further comprising:

fastening means for fastening the securing member to a decking support structure, said fastening means including a seating means for seating against the annular ledge to thereby prevent removal of the securing member from the decking support structure.

31. The deck-board securing device of claim 30, wherein the fastening means comprises a screw.

32. The deck-board securing device of claim 29, wherein the annular ledge is planer.

33. The deck-board securing device of claim 29, wherein the annular ledge is frusto-conical.

34. A deck-board securing device for securing deck boards in place as part of a decking structure, said securing device comprising:

a securing member comprising a lower portion and an upper portion disposed on the lower portion, a first cantilever portion extending outwardly from said upper portion in a first directions to form a first overhang with respect to the lower portion, and an opposing second cantilever portion extending outwardly from said upper portion in a second direction to form an opposing second overhang with respect to the lower portion, at least one of the overhangs including a nub formed on an under surface thereof, said first overhang being configured and dimensioned to extend into a receiving chamber formed in a deck board; and turning means for (i) turning the securing member in a first rotational direction to thereby move the first overhand into engagement with a deck board, and (ii) turning the securing member in a second rotational direction to thereby move the first overhang out of engagement with the deck board.

35. The deck-board securing device of claim 34, wherein the nub extends in an orthogonal direction with respect to the upper portion of the securing member.

36. The deck-board securing device of claim 35, wherein said overhangs each have a nub formed on under surfaces thereof.

37. A decking system comprising:

a plurality of deck boards for placing on a decking support structure; and securing means rotatably attachable to the decking support structure for releasably securing the deck boards to the decking support structure;

wherein the deck boards each have a hollow cross section defined by an upper wall, a bottom wall, a first sidewall and an opposing second sidewall extending from opposing sides of the upper wall, respectively, and a first corner wall and an opposing second corner wall interconnecting the first sidewall with the bottom wall and the second sidewall with the bottom wall, respectively.

38. The decking system of claim 37, wherein the decking boards include a receiving chamber formed therein.

39. The decking system of claim 38, wherein the receiving chamber is defined in part by a channel member having a J-shaped cross section.

40. The decking system of claim 37, wherein the deck boards each further comprise a first J-shaped channel member extending from a first edge of the bottom wall, and a second J-shaped channel member extending from an opposing second edge of the bottom wall.

41. The decking system of claim 37, wherein each of the J-shaped channel members includes a sidewall that is disposed in a substantial co-planer orientation with respect to the bottom wall.

42. The decking system of claim 37, wherein each of the J-shaped channel members includes three sequentially intercoupled sidewalls.

43. The decking system of claim 42, wherein each corner wall comprises two interconnected sidewalls, and wherein all of the intercoupled sidewalls of the J-shaped channel members are narrower than each sidewall of the corner walls.

44. The decking system of claim 37, wherein the securing means comprises a securing member having a first portion and a second portion fixedly secured to the first portion, said first portion having an overhang portion extending outwardly to define an extension portion that extends outwardly with respect to the second portion, said extension portion being configured and dimensioned to extend into a receiving chamber formed in a deck board.

45. The decking system of claim 37, wherein the deck boards each comprise a hollow cross section defined in part by an upper wall and a bottom wall, said deck boards each further comprising a first J-shaped channel member extending outwardly from a first edge of the bottom wall.

46. The decking system of claim 45, wherein the decking boards each further comprise a second J-shaped channel member extending outwardly from an opposing second edge of the bottom wall.

47. The decking system of claim 46, wherein the securing means comprises means for engaging simultaneously with J-shaped channel members of two adjacent decking boards.

48. The decking system of claim 47, wherein the J-shaped channel members are made from a resilient material having elastic memory.

49. The decking system of claim 37, further comprising:

turning means for (i) turning the securing means in a first rotational direction to thereby move the extension portion into engagement with a deck board, and (ii) turning the securing means in a second rotational direction to thereby move the extension portion out of engagement with the deck board.

50. A decking system comprising:

a plurality of decking boards for placing on a decking support structure, said decking boards each comprising a hollow cross section defined in part by an upper wall and a bottom wall;

the decking boards each further comprising a first J-shaped channel member extending outwardly from an opposing first edge of the bottom wall, and a second J-shaped channel member extending outwardly from an opposing second edge of the bottom wall; and securing means rotatable attachable to the decking support structure for releasably securing the decking boards to the decking support structure;

the securing means further comprising means for engaging with the first J-shaped channel member.

51. A decking system comprising:

a plurality of decking boards for placing on a decking support structure;

securing means rotatably attachable to the decking support structure for releasably securing the decking boards to the decking support structure; and fastening means for fastening the securing member to a decking support structure.

52. The decking system of claim 51, wherein the fastening means comprises means for rotatably fastening the securing member to a decking support structure.

53. A decking system comprising:

a plurality of deck boards for placing on a decking support structure; and securing means rotatably attachable to the decking support structure for releasably securing the deck boards to the decking support structure, the securing means including a through-passage formed therein.

54. The decking system of claim 53, wherein the through-passage includes a wider, upper portion and a narrower, lower portion.

55. The decking system of claim 54, wherein the through-passage includes a wider, upper portion having a non-circular cross-sectional shape, and a narrower, lower portion.

56. The decking system of claim 55, further comprising:

turning means for (i) turning the securing means in a first rotational direction to thereby move the extension portion into engagement with a deck board, and (ii) turning the securing means in a second rotational direction to thereby move the extension portion out of engagement with the deck board;

wherein the turning means includes a distal end portion that is narrower than the upper portion of the through-passage and wider than the lower portion of the through-passage.

57. The decking system of claim 55, wherein the narrower, lower portion of the through-passage has a circular cross-sectional shape.

58. The decking system of claim 55, wherein the wider, upper portion of the through-passage has a square cross-sectional shape.

59. The decking system of claim 58, further comprising:

turning means for (i) turning the securing means in a first rotational direction to thereby move the extension portion into engagement with a deck board, and (ii) turning the securing means in a second rotational direction to thereby move the extension portion out of engagement with the deck board;

wherein the turning means comprises an elongate rod terminating in a distal end portion having a square cross-sectional shape configured and dimensioned to fit within the wider, upper portion of the through-passage.

60. A deck-board attachment device for attaching deck boards in place as part of a decking structure, said attachment device comprising:

attachment means for releasably attaching deck boards to a decking support structure;

operating means for operating the attachment means to thereby release at least one deck board from attachment to the decking support structure without removing the attachment means from the deck ing support structure.

61. The deck-board attachment device of claim 60, wherein the operating means further comprises means for releasing at least one deck board from attachment to the decking support structure without detaching any other portion of the deck.

62. The deck-board attachment device of claim 60, wherein the attachment means comprises a clip that is rotatably attachable to the decking support structure, the clip having a first wing, the deck-board attachment device further comprising:

turning means for (i) turning the clip in a first rotational direction to thereby move the first wing into engagement with a deck board, and (ii) turning the securing member in a second rotational direction to thereby move the first wing out of engagement with the deck board.

63. The deck-board attachment device of claim 62, wherein the operating means including an elongate rod portion terminating in a distal end portion.

64. The deck-board attachment device of claim 63, wherein the distal end portion is square in cross section.

65. A decking system comprising:

a plurality of decking boards for placing on a decking support structure;

securing means rotatably attachable to the decking support structure for releasably securing the decking boards to the decking support structure;

wherein the decking boards include a receiving chamber formed therein;

wherein the decking boards are hollow;

wherein the decking boards each have a hollow cross section defined by an upper wall, a bottom wall, a first sidewall and an opposing second sidewall extending from opposing sides of the upper wall, respectively, and a first corner wall and an opposing second corner wall interconnecting the first sidewall with the bottom wall and the second sidewall with the bottom wall, respectively;

wherein the decking boards each further comprise a first J-shaped channel member extending from a first edge of the bottom wall, and a second J-shaped channel member extending from an opposing second edge of the bottom wall;

wherein each of the J-shaped channel members includes a sidewall that is disposed in a substantial co-planer orientation with respect to the bottom wall;

where in the each of the J-shaped channel members includes three sequentially intercoupled sidewalls;

wherein each corner wall comprises two interconnected sidewalls, and wherein all of the sequentially intercoupled sidewalls of the J-shaped channel members are narrower than each sidewall of the corner walls;

wherein the securing means comprises a securing member having a first portion and a second portion fixedly secured to the first portion, said first portion having an overhang portion extending outwardly to define an extension portion that extends outwardly with respect to the second portion, said extension portion being configured and dimensioned to extend into a receiving chamber formed in a decking board;

wherein the decking boards each comprise a first J-shaped channel member extending outwardly from a first edge of the bottom wall;

wherein the securing means comprises means for engaging with the first J-shaped channel member;

wherein the securing means comprises means for engaging simultaneously with said J-shaped channel members of two adjacent decking boards;

wherein the J-shaped channel members are made from a resilient material having elastic memory;

turning means for (i) turning the securing means in a first rotational direction to thereby move the extension portion into engagement with a decking board, and (ii) turning the securing means in a second rotational direction to thereby move the extension portion out of engagement with the decking board;

fastening means for fastening the securing member to a decking support structure;

wherein the fastening means comprises means for rotatably fastening the securing member to a decking support structure;

wherein the securing means includes a through-passage formed therein;

wherein the through-passage includes an upper portion and a lower portion, the upper portion being relatively wider with respect to the lower portion and the lower portion being relatively narrower with respect to the upper portion;

wherein the through-passage includes a wider, upper portion having a non-circular cross-sectional shape, and a narrower, lower portion;

wherein the turning means includes a distal end portion that is narrower than the upper portion of the through-passage and wider than the lower portion of the through-passage;

wherein the narrower, lower portion of the through-passage has a circular cross-sectional shape;

wherein the wider, upper portion of the through-passage has a square cross-sectional shape;

wherein the turning means comprises an elongate rod terminating in a distal end portion having a square cross-sectional shape configured and dimensioned to fit within the wider, upper portion of the through-passage;

wherein the second portion of the securing member comprises a lower portion, and wherein the first portion of the securing member comprises an upper portion having a first cantilever portion extending outwardly in a first direction to form a first overhang with respect to the lower portion, and an opposing second cantilever portion extending outwardly in a second direction to form an opposing second overhang with respect to the lower portion;

wherein the first overhang and the second overhang each includes a nub formed on an under surface thereof.

66. A method of releasably securing deck boards in place as part of a decking structure, said method comprising the steps of:

(a) selecting a deck board having a receiving chamber formed therein;

(b) placing the deck board upon a deck support;

(c) attaching a securing member to the deck support, and positioning said securing member such that an overhang portion of said securing member extends into the receiving chamber of the deck board;

wherein step (d) further comprises rotatably attaching the securing member to the deck support.

67. The method of claim 66, wherein step (c) further comprises rotatably attaching the securing member to the deck support.

68. A method of releasably securing and removing deck boards in place as part of a decking structure, said method comprising the steps of:

(a) selecting a deck board having a receiving chamber formed therein;

(b) placing the deck board upon a deck support;

(c) attaching a securing member to any suitable structure, and positioning said securing member such that an overhang portion of said securing member extends into the receiving chamber of the deck board; and (d) rotating the securing member to thereby move the overhang portion of said securing member out of the receiving chamber of the deck board.

69. The method of claim 68, wherein step (d) further comprises inserting a turning member having a non-circular distal end portion between two adjacent deck boards, engaging the securing member with the turning member, and turning said securing member with said turning member to thereby move the overhang portion of the securing member out of the receiving chamber of the deck board.

70. The decking system of claim 37, wherein the decking boards are hollow.

* * * * *